US009997851B1

(12) United States Patent
Ekrot

(10) Patent No.: US 9,997,851 B1
(45) Date of Patent: Jun. 12, 2018

(54) POWER CONNECTORS WITH FUSIBLE REGIONS

(71) Applicant: HEWLETT PACKARD ENTERPRISE DEVELOPMENT LP, Houston, TX (US)

(72) Inventor: Alexander C. Ekrot, Houston, TX (US)

(73) Assignee: HEWLETT PACKARD ENTERPRISE DEVELOPMENT LP, Houston, TX (US)

( * ) Notice: Subject to any disclaimer, the term of this patent is extended or adjusted under 35 U.S.C. 154(b) by 0 days. days.

(21) Appl. No.: 15/493,377

(22) Filed: Apr. 21, 2017

(51) Int. Cl.
*H01R 12/71* (2011.01)
*H01R 24/76* (2011.01)
*H01R 103/00* (2006.01)

(52) U.S. Cl.
CPC ..... *H01R 12/716* (2013.01); *H01R 24/76* (2013.01); *H01R 2103/00* (2013.01)

(58) Field of Classification Search
CPC .... H01R 9/2441; H01R 9/245; H01R 9/2641; H01R 9/265; H01R 13/68; H01R 13/696; H01R 33/95
USPC ..... 439/620.08
See application file for complete search history.

(56) References Cited

U.S. PATENT DOCUMENTS

| | | | | |
|---|---|---|---|---|
| 7,515,399 | B2 * | 4/2009 | Kriegesmann ..... | H01H 85/044 337/198 |
| 7,782,632 | B2 | 8/2010 | Della Fiora et al. | |
| 7,969,275 | B2 | 6/2011 | Hartzog | |
| 9,209,622 | B2 | 12/2015 | Wishman et al. | |
| 2014/0035717 | A1 | 2/2014 | Nomura et al. | |

FOREIGN PATENT DOCUMENTS

| | | | |
|---|---|---|---|
| JP | 10283906 | A | 10/1998 |
| JP | 2013175389 | A | 9/2013 |

* cited by examiner

*Primary Examiner* — Ross Gushi
(74) *Attorney, Agent, or Firm* — Hewlett Packard Enterprise Patent Department

(57) ABSTRACT

Example implementations relate to a power connector. For example, an implementation of a power connector includes a circuit board contact to insert into a circuit board, a pluggable power input contact to removably plug into a power distribution system of an electronic system external to the circuit board, and a conductive body connecting the pluggable power input contact and the circuit board contact. The conductive body may be narrowed to a fusible region between the pluggable power input contact and the circuit board contact.

20 Claims, 5 Drawing Sheets

POWER CONNECTORS WITH FUSIBLE REGIONS

BACKGROUND

A modular system, such as a blade server, may be plugged into a larger overall system, such as a blade enclosure. The modular system may receive power from the larger overall system.

BRIEF DESCRIPTION OF THE DRAWINGS

Various examples will be described below with reference to the following figures.

Figure 1:
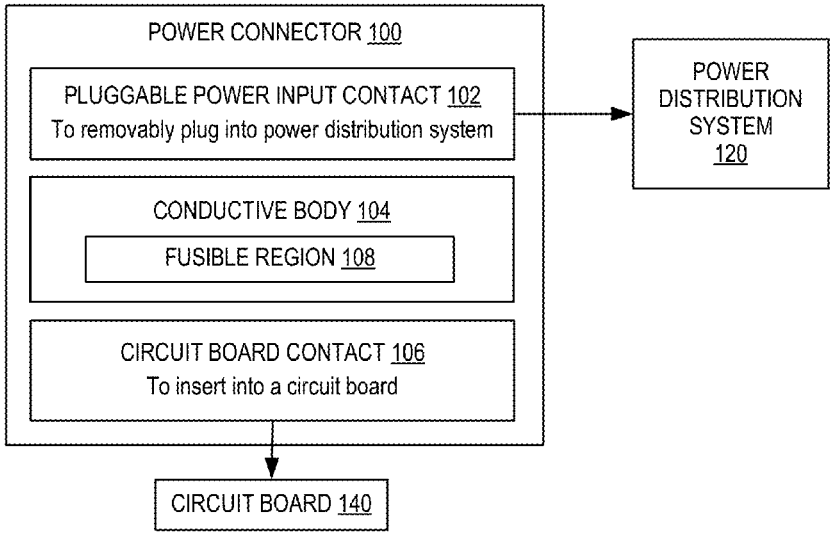
FIG. 1 depicts a block diagram of an example power connector with a fusible region.

Throughout the drawings, identical reference numbers may designate similar, but not necessarily identical, elements. Use herein of a reference numeral without a hyphenated index number, where such reference numeral is referred to elsewhere with a hyphenated index number, may be a general reference to the corresponding plural elements, collectively or individually.

DETAILED DESCRIPTION

Some computing systems may take the form of a modular system within a larger overall system. Such modular systems may be made to be plugged into and pulled out of the larger system. In this manner, the physical configuration of the larger system can be changed quickly and easily. In some cases, the modular system may be a blade computing system (which may include compute, storage, networking, or any combination thereof), and the larger overall system into which the modular system is removably plugged into may include a blade enclosure (also referred to as a blade chassis).

A modular system may include a printed circuit assembly (PCA) that is a circuit board with electronic components and traces. The circuit board may contain multiple planes, such as a power plane, a ground plane, and a signal plane. The power plane and the ground plane may deliver electrical power to the components of the PCA. The modular system may include a power connector to receive power from an enclosure in which the modular system is installed. Because an enclosure may receive multiple modular systems, the enclosure may include a common, shared power delivery system capable of delivering over ten kilowatts in some examples (i.e., hundreds of amps at 12V) in order to power each of the modular systems plugged into the enclosure.

The circuit board of a modular system may develop a PCA-level short circuit, and in particular, a PCA-level short that is a short between the power plane and the ground plane. Such high current electrical failures may be the result of latent manufacturing or assembly errors (e.g., over-tightened screws, incorrect screws) or of foreign objects unintentionally introduced inside the modular system shorting between ground and power contacts. Moreover, such a PCA-level short may draw hundreds of amps at 12V and cause temperatures of 2000° F., for example. A PCA-level short may destroy the modular system, and also may backpropagate and cause catastrophic damage to the enclosure in which the modular system is installed.

A modular system may employ a primary protection element, such as an electronic fuse or thermal fuse, to provide overcurrent protection to sensitive electronic components included in the modular system (e.g., processor, memory, etc.), but the primary protection element also may fail or may be unable to protect against the current draw associated with a plane-to-plane PCA-level short. For example, the interrupting rating (also referred to as a breaking capacity) of the primary protection element may be exceeded by the current draw of the PCA-level short. Moreover, a primary protection element may be separated from the power connector of the modular system (e.g., by up to a three inch trace, in some cases) for reasons related to PCA layout design or like considerations, and such a primary protection element may be unable to mitigate electrical failures such as short circuits arising upstream (i.e., in the separation distance between the primary protection element and the power connector).

Accordingly, it may be useful to provide a power connector having a circuit board contact to insert into a circuit board, a pluggable power input contact to removably plug into a power distribution system of an electronic system external to the circuit board, and a conductive body connecting the pluggable power input contact and the circuit board contact, where the conductive body is narrowed to a fusible region between the pluggable power input contact and the circuit board contact. In some examples, the power connector may be employed by a blade computing system to connect to a power distribution system of a blade enclosure.

By virtue of integrating a fusible region in the conductive body of a power connector, cost-effective and space-efficient protection may be provided against catastrophic system level power failures. The power connector with integrated fusible region may be readily employed into a wide variety of electronic systems, and does not interfere with existing primary protection elements. Furthermore, integrating a fusible region into the power connector may provide protection from short circuits and electrical failures upstream of any primary protection that is separated from the power connector.

Referring now to the figures, FIG. 1 depicts a block diagram of an example power connector 100. The power connector 100 includes a pluggable power input contact 102, a conductive body 104, and a circuit board contact 106. The circuit board contact 106 is to insert into a circuit board 140. The circuit board contact 106 may be affixed to the circuit board 140, mechanically and electrically, by solder for example. The circuit board 140 with the power connector 100 installed thereon (by affixing the circuit board contact 106), may be a system in and of itself, such as a printed circuit assembly for installation into a computing system (such as a blade computing system) or other electronic system.

The pluggable power input contact 102 is to removably plug into a power distribution system 120 of an electronic system external to the circuit board 140. For example, the pluggable power input contact 102 may be a female barrel connector and the power distribution system 120 may include male connector pins, or vice versa. The pluggable power input contact 102 and power distribution system 120 may employ other forms or shapes to removably connect, such as a blade or prong. In an example, the pluggable power input contact 102 may connect to a power output (e.g., +12V or other voltage level) of the power distribution system 120.

The conductive body 104 connects, structurally and electrically, the pluggable power input contact 102 and the circuit board contact 106. The conductive body 104 is narrowed to a fusible region 108 between the pluggable power input contact 102 and the circuit board contact 106. The fusible region 108 is integral to the conductive body 104. For example, metal casting, die cutting and forming, or other processes may be used to manufacture the conductive body 104 with the shape of the fusible region 108.

The fusible region 108 is designed as a narrowed portion of the conductive body 104 through which current will flow between the pluggable power input contact 102 and the circuit board 140 (via circuit board contact 106). The particular dimensions of the fusible region 108 may be application specific and may be selected such that the fusible region 108 fuses open at a current that is high above a normal operating current of a system in which the circuit board 140 is employed (e.g., high above by a threshold greater than other fuses of that system) yet exhibits a voltage drop and local heating that are within operating tolerances of the system. For example, the fusible region 108 may be designed using modeling tools such as computer-aided design (CAD) and finite element analysis (FEA), experimental methodologies such as design of experiments (DOE), or other techniques.

In some implementations, the blade computing system 110 may have a primary overcurrent and/or short circuit protection, such as an electronic fuse or other fuse. The primary protection may be installed on the circuit board 140. In such implementations, the power connector 100 with fusible region 108 may serve as a secondary or backup protection, in case, for example, of a failure of the primary protection or an overcurrent or short circuit failure of the circuit board 140 that is otherwise not mitigated by the primary protection. For example, the fusible region 108 may have a current rating (i.e., current at which the fusible region 108 opens) greater than the current rating of the primary protection of the circuit board 140. The fusible region 108 also may have an interrupting rating greater than an interrupting rating of the primary protection of the circuit board 140. In some examples, the power connector 100 provides protection for the circuit board 140 from plane-to-plane short circuits. By virtue of the fusible region 108, the power connector 100 may prevent the backpropagation of a system or board level short to the power distribution system 120.

In some implementations, the power connector 100 may have a maximum current rating that is higher than the current demand of the blade computing system 110, and for example, a maximum current rating that is approximately twice the current demand of the blade computing system 110. In such a case, the fusible region 108 may be designed to fuse open at a current rating that is greater than the maximum current rating of the power connector 100 and, for example, greater than or equal to five times the maximum current rating of the power connector 100. By comparison, a primary protection may have a current rating of 1.2 to 1.5 times the maximum current rating of the power connector 100 in some examples.

Figure 2:
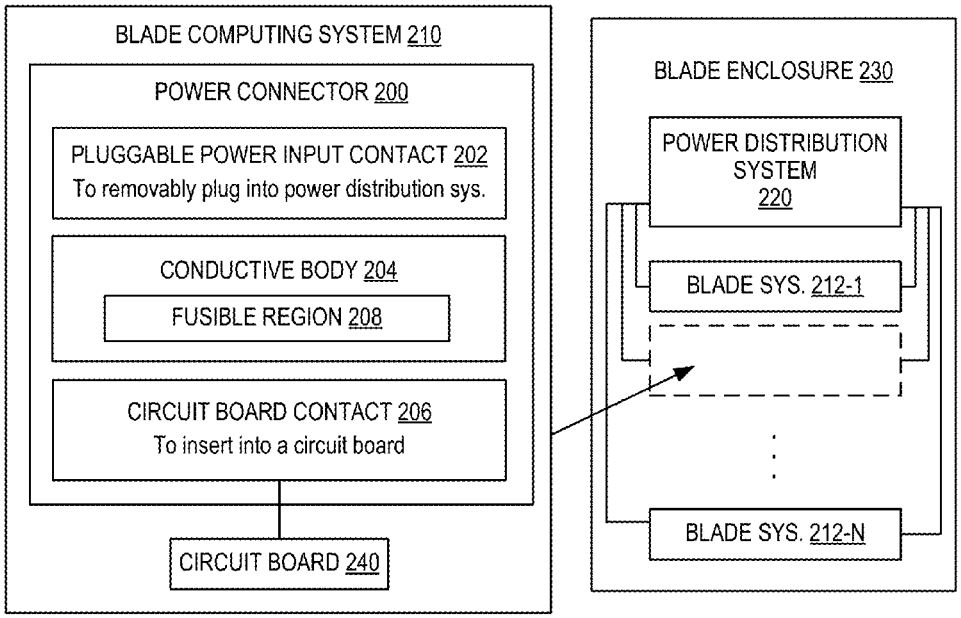
FIG. 2 depicts a block diagram of an example power connector included in a blade computing system removably installable to a blade enclosure.

FIG. 2 depicts a block diagram of an example power connector 200 included in a blade computing system 210. The blade computing system 210 is removably installable to a blade enclosure 230 (e.g., in FIG. 2, installable into a bay depicted as a dashed rectangle). The blade enclosure 230 also may receive and hold other blade computing systems 212-1 through 212-N.

The blade enclosure 230 may include a power distribution system 220 to provide power to each of the plurality of blade computing systems 212-1 through 212-N, and blade computing system 210 when installed. In an example, the power distribution system 220 may include redundant power supplies (e.g., N+N configuration, 2 N+1 configuration, etc.).

The blade computing system 210 may enclose a circuit board 240 with a power connector 200 installed thereon. In some implementations, the circuit board 240 may be a system board of the blade computing system 210. The power connector 200 may be analogous in many respects to the power connector 100 described above with respect to FIG. 1. More particularly, the power connector 200 may include a pluggable power input contact 202 to removably plug into the power distribution system 220 and a circuit board contact 206 by which the power connector 200 may be installed on the circuit board 240. The power connector 200 includes a conductive body 204 that electrically and structurally connects the contacts 202 and 206, and the conductive body 204 is narrowed to an integrated fusible region 208 in a manner similar to the conductive body 104 described above.

In some implementations, a ground connector may accompany the pluggable power input contact 202. The ground connector may connect to the circuit board 240 and to the power distribution system 120, to provide a ground to the blade computing system 210. A housing may enclose the pluggable power input contact 202, as well as the pluggable ground contact, and the housing may have mating features to facilitate blind mating of the blade computing system 210 to the power distribution system 220.

As described above, the power distribution system 220 may include redundant power supplies. To make use of the redundant power supplies, an implementation of the power connector 200 may include a plurality (i.e., more than one) of pluggable power input contacts and a plurality of circuit board contacts. An example of a redundant power supply compatible power connector will now be described with reference to FIGS. 3A, 3B, 3C.

Figure 3A:
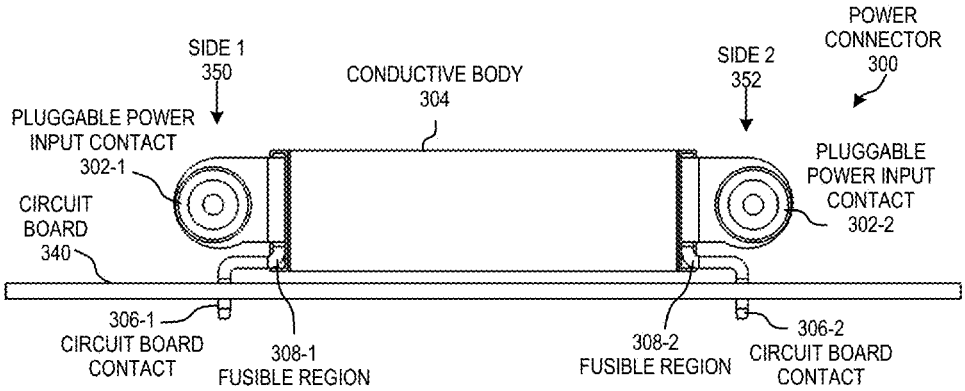
FIG. 3A depicts a front view of an example power connector.
Figure 3B:
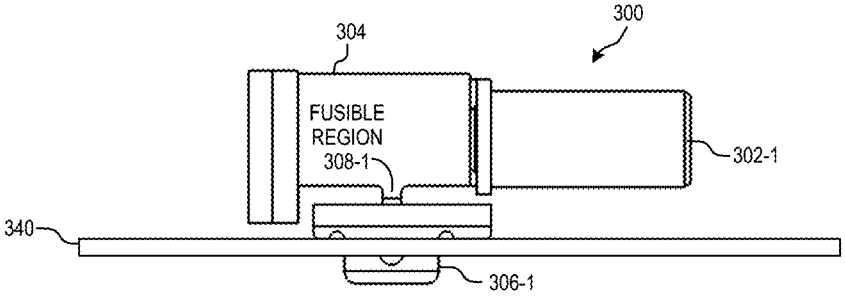
FIG. 3B depicts a side view of the example power connector of FIG. 3A.
Figure 3C:
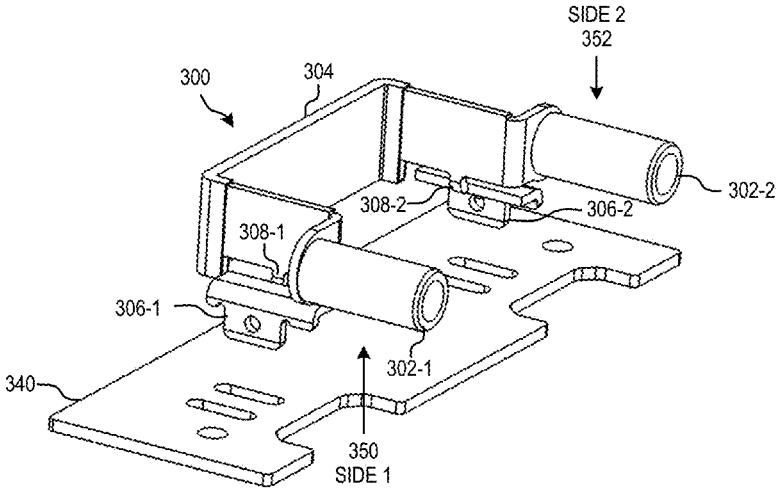
FIG. 3C depicts a perspective view of the example power connector of FIG. 3A.

FIGS. 3A, 3B, and 3C depict, respectively, a front view, a side view, and a perspective view of an example power connector 300. The power connector 300 includes a plurality of pluggable power input contacts, and in particular, two pluggable power input contacts 302-1, 302-2 for N+N redundancy (or other compatible configurations) at a power distribution system (e.g., 120, 220). Other designs of power connector (e.g., including different numbers of contacts than two) also are contemplated for other types of power distribution system redundancy. The pluggable power input contacts 302-1, 302-2 may removably plug into the power distribution system. The pluggable power input contacts 302-1, 302-2 are connected, electrically and structurally, to a conductive body 304.

The power connector 300 also includes a plurality of circuit board contacts 306-1, 306-2, which are inserted into slots in a circuit board 304, which may be analogous in many respects to the circuit board 204, and may be a system board of a blade computing system. The circuit board contacts 306-1, 306-2 may be affixed to the circuit board 304, by solder for example.

Each of the plurality of circuit board contacts 306-1, 306-2 may be in line with the plurality of pluggable power input contacts 302-1, 302-2, and the conductive body 304 may include a plurality of integral fusible regions 308-1, 308-2 between the plurality of circuit board contacts 306-1, 306-2 and the pluggable power input contacts 302-1, 302-2. For example, a "side 1" 350 of the connector 300 may include the fusible region 308-1 disposed between the circuit board contact 306-1 and the pluggable power input contact 302-1, and a "side 2" 352 of the connector 300 may include the fusible region 308-2 disposed between the circuit board contact 306-2 and the pluggable power input contact 302-2.

In some implementations, the fusible regions 308-1, 308-2 may be at a shoulder portion of the conductive body 304, as depicted in FIGS. 3A, 3B, 3C. Accordingly, the fusible regions 308-1, 308-2 may be elevated above the circuit board 340 when the circuit board contacts 306-1, 306-2 are inserted into the circuit board 340. Such elevation and separation may be useful for reducing any heat transfer from the fusible regions 308-1, 308-2 to the circuit board 340.

The width of the integral fusible regions 308-1, 308-2 may be designed in a manner similar to the fusible region 108, as described above, e.g., by modeling and/or empirical experimentation, taking into account an expected load on the circuit board 340, the current supply of the power distribution system, and other considerations. The fusible regions 308-1, 308-2 may be designed to fuse open at a particular current rating that is higher than the current rating of a primary overcurrent protection device on the circuit board 340.

A power distribution system with redundant outputs may include diodes to control to which pluggable power input contact 302-1, 302-2 current is delivered. Current flowing in from either pluggable power input contact 302-1 or 302-2 may flow to both circuit board contacts 306-1, 306-2, by virtue of the conductive body 304 electrically and structurally connecting the pluggable power input contacts 302-1, 302-2 and the circuit board contacts 306-1, 306-2. Thus, the width (i.e., thickness) of the integral fusible regions may be inversely related to a quantity of the plurality of circuit board contacts 306, since the plurality of circuit board contacts 306 present as parallel paths. A greater quantity of circuit board contacts 306 (e.g., in a system with more redundancy) may decrease the amount of current flowing through any particular integral fusible region, which may decrease the current rating of the fusible region and thus the designed thickness or width to fuse open at the current rating.

Figure 4A:
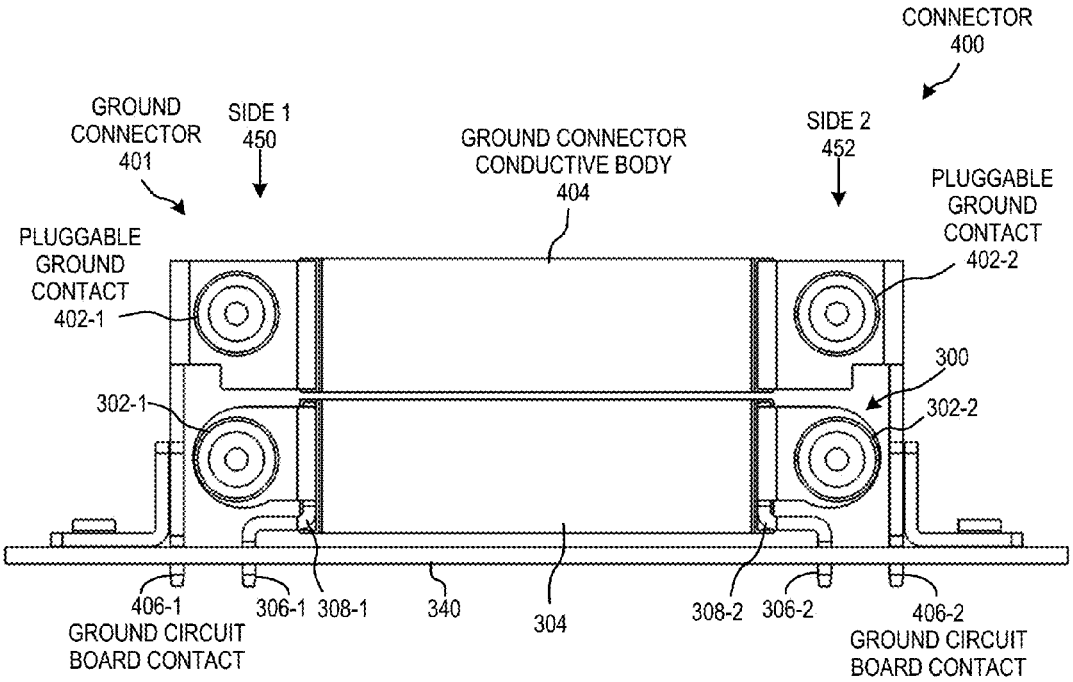
FIG. 4A depicts a front view of an example connector having a power connector and a ground connector.
Figure 4B:
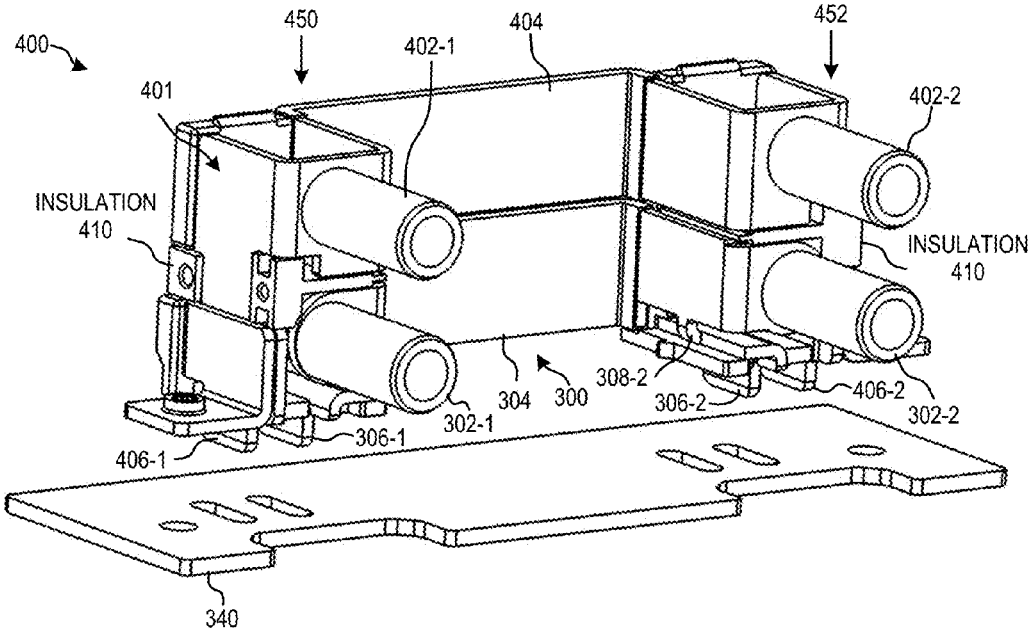
FIG. 4B depicts a perspective view of the example connector of FIG. 4A.

FIGS. 4A and 4B depict, respectively, a front view and a perspective view of an example connector 400. The connector 400 may include the power connector 300 and a ground connector 401. The connector 400 may be installed to a circuit board 340.

The power connector 300 may, as described above with respect to FIGS. 3A, 3B, 3C, include pluggable power input connectors 302-1, 302-2 to connect to a power output (e.g., +12V, etc.) of a power distribution system (e.g., 120 or 220); circuit board contacts 306-1, 306-2; and a conductive body 304 with fusible regions 308-1, 308-2. The power connector 300 may be installed to the circuit board 340, and more particularly the circuit board contacts 306-1, 306-2 may be electrically coupled (e.g., by solder) to traces connected to a power plane of the circuit board 340.

The ground connector 401 may include a plurality of pluggable ground contacts 402-1, 402-2 to removably plug to a ground connection of a power distribution system. The ground connector 401 also includes a plurality of ground circuit board contacts 406-1, 406-2 to affix to the circuit board 340, and more particularly, the ground circuit board contacts 406-1, 406-2 may be electrically coupled to traces connected to a ground plane of the circuit board 340. A ground connector conductive body 404 may electrically and structurally connect the pluggable ground contacts 402-1, 402-2 to the ground circuit board contacts 406-1, 406-2. In an example, the ground connector conductive body 404 does not include any fusible regions, particularly because multiple ground return paths exist through to the power distribution system (e.g., through a chassis of the computing system in which the circuit board 340 is installed). The connector 400 also may include insulation 410, as depicted in FIG. 4B, between the power connector 300 (e.g., the conductive body 304 thereof) and the ground connector 401 (e.g., the ground connector conductive body 404).

Respective ones of the plurality of pluggable ground contact 402-1, 402-2 and the pluggable power input contacts 302-1, 302-2 may form respective pairs. For example, a "side 1" 450 of the connector 400 may have a pair that includes the pluggable ground contact 402-1 and the pluggable power input contact 302-1, and a "side 2" 452 of the connector 400 may have a pair that includes the pluggable ground contact 402-2 and the pluggable power input contact 302-2. The pairs of "side 1" 450 and "side 2" 452 may connect to different redundant power supply connections of the power distribution system.

Figure 5:
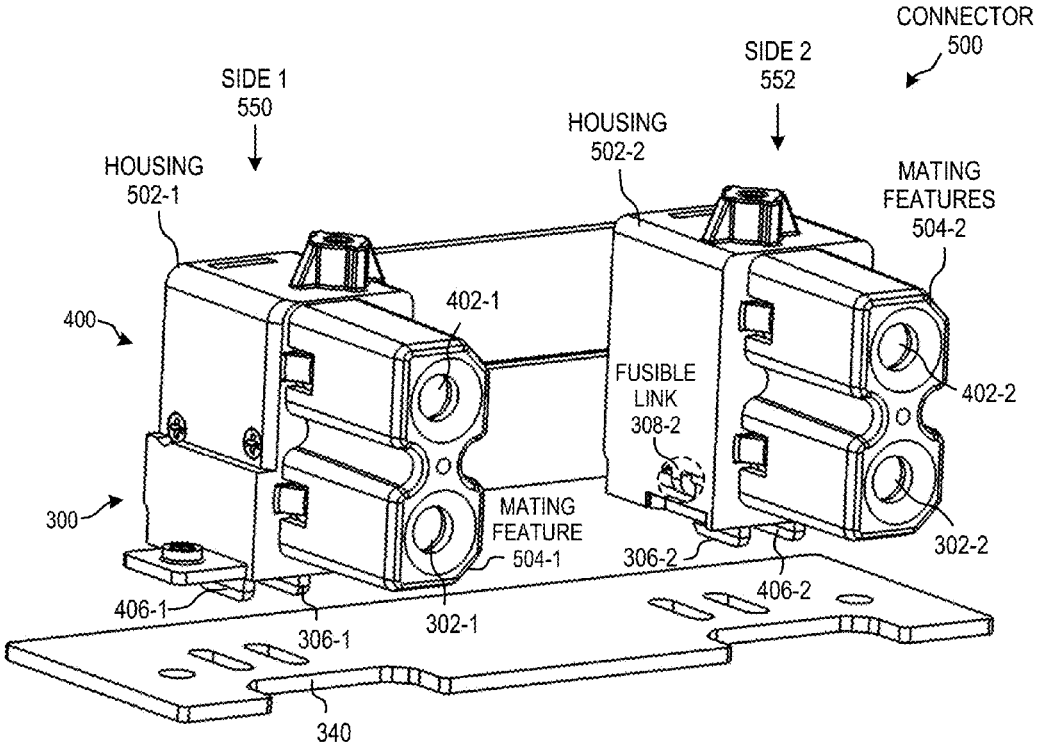
FIG. 5 depicts a perspective view of an example connector with housings.

FIG. 5 depicts a perspective view of an example connector 500. The connector 500 may include a power connector 300 and a ground connector 401, which may be analogous to the power connector 300 and the ground connector 401 described above with respect to FIGS. 3A, 3B, 3C, 4A, and 4B. For example, the power connector 300 may include at least one fusible link (e.g., 308-2, shown in a cutaway of housing 502-2). The connector 500 may be installed to a circuit board 340, by way of circuit board contacts 306-1, 306-2, and ground circuit board contacts 406-1, 406-2.

The connector 500 may include housings to enclose each respective pair of pluggable power input contact and pluggable ground contact. For example, a "side 1" 550 of the connector 500 may have a housing 502-1 that encloses the pluggable power input contact 302-1 and the pluggable ground contact 402-1, and a "side 2" 552 of the connector 500 may have a housing 502-2 that encloses the pluggable power input contact 302-2 and the pluggable ground contact 402-2.

In some implementations, the housings may include mating features to blind-mate to a power distribution system (e.g., 120, 220). For example, mating features may include certain shapes, tapers, chamfered edges, etc. to guide the pluggable contacts into connection with complementary or corresponding contacts at the power distribution system. In some implementations, the housings may contain, confine, or suppress heat and debris generated from a fusing event at a fusible link (e.g., 308-1, 308-2).

Figure 6:
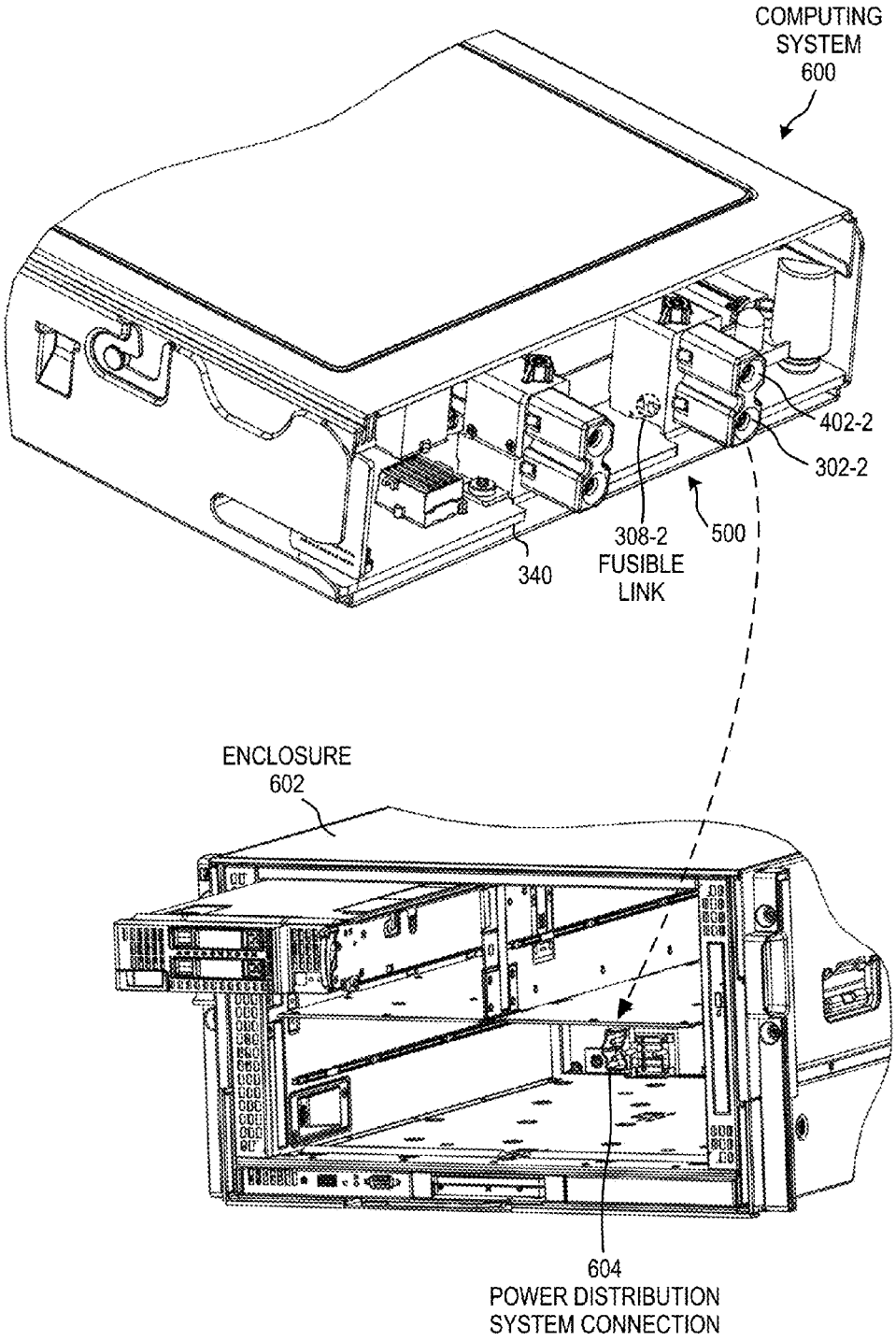
FIG. 6 depicts an example connector included in a computing system.

FIG. 6 depicts an example connector installed on a circuit board 340 of a computing system 600. The computing system 600 may be a blade computing system (e.g., having compute, storage, and/or networking). The connector may be similar in many respects to the connectors described above, such as the connector 500, and is depicted, for example, as having at least a fusible link 308-2 (shown in a cutaway), a pluggable power input contact 302-2, and a pluggable ground contact 402-2.

The computing system 600 with connector 500 (having an integral fusible link on a power connector) may be inserted into an enclosure 602 (e.g., a blade enclosure). The pluggable power input contacts and pluggable ground contacts of the connector 500 may connect with a power distribution system connection 604 of the enclosure 602 (symbolized in FIG. 6 as a dashed arrow).

In the foregoing description, numerous details are set forth to provide an understanding of the subject matter disclosed herein. However, implementation may be practiced without some or all of these details. Other implementations may include modifications and variations from the details discussed above. It is intended that the following claims cover such modifications and variations.

What is claimed:

1. A system comprising:

a circuit board; and a power connector installed on the circuit board, the power connector including:

a pluggable power input contact to removably plug into a power distribution system external to the circuit board, a circuit board contact to affix to a power trace of the circuit board, and a conductive body with an integral fusible region connecting the pluggable power input contact and the circuit board contact, wherein the circuit board and the power connector are enclosed in a blade computing system, and the power distribution system is in a blade enclosure to which the blade computing system is removably installable.

2. The system of claim 1, wherein the fusible region fuses open at a current rating that is greater than or equal to three times the maximum current rating of the power connector.

3. The system of claim 1, wherein the integral fusible region is between the conductive body and the circuit board contact.

4. The system of claim 1, wherein the power connector includes a plurality of pluggable power input contacts to removably plug into the power distribution system, the plurality of pluggable power input contacts being connected to the conductive body.

5. The system of claim 4, wherein the power distribution system includes redundant power supplies, and each of the plurality of pluggable power input contacts is to removably plug into a respective redundant power supply.

6. The system of claim 4, wherein the power connector includes a plurality of circuit board contacts, each of the plurality of circuit board contacts being in line with each of the plurality of pluggable power input contacts, and the conductive body includes a plurality of integral fusible regions between the plurality of circuit board contacts and the plurality of pluggable power input contacts.

7. The system of claim 6, wherein a width of the integral fusible regions is inversely related to a quantity of the plurality of pluggable power input contacts.

8. The system of claim 6, further comprising:

a ground connector installed on the circuit board, the ground connector including a plurality of pluggable ground contacts to removably plug into the power distribution system and a plurality of ground circuit board contacts to affix to the circuit board, the plurality of pluggable ground contacts connected to the plurality of ground circuit board contacts by a ground connector conductive body; and housings that enclose respective pairs of pluggable power input contact and pluggable ground contact.

9. The system of claim 8, wherein the housings include mating features to blind-mate to the power distribution system.

10. The system of claim 1, wherein the power connector is to provide protection from electrical failures of the circuit board including a plane-to-plane short circuit or a foreign object short circuit.

11. A power connector comprising:

a circuit board contact to insert into a circuit board;

a pluggable power input contact to removably plug into a power distribution system of an electronic system external to the circuit board; and a conductive body connecting the pluggable power input contact and the circuit board contact, the conductive body being narrowed to a fusible region between the pluggable power input contact and the circuit board contact, wherein the fusible region has an interrupting rating greater than an interrupting rating of a primary fuse of the circuit board.

12. The power connector of claim 11, wherein the fusible region fuses open at a current rating that is in a range from three times to ten times the maximum current rating of the power connector.

13. The power connector of claim 11, comprising:

a plurality of circuit board contacts to insert into the circuit board, the circuit board contact being included among the plurality of circuit board contacts; and a plurality of pluggable power input contacts to removably plug into respective redundant power supplies of the power distribution system, the pluggable power input contact being included among the plurality of circuit board contacts, wherein the conductive body connects the plurality of circuit board contacts to the plurality of pluggable power input contacts, and the conductive body includes a fusible region between each of the circuit board contacts and a respective pluggable power input contact of the plurality of pluggable power input contacts.

14. The power connector of claim 11, wherein the circuit board is a system board of a blade computing system.

15. The power connector of claim 14, wherein the fusible region between each of the circuit board contacts and the respective pluggable power input contact is at a shoulder portion of the conductive body and is elevated above the circuit board when the circuit board contacts are inserted into the circuit board.

16. The power connector of claim 14, wherein a width of the fusible region between each of the circuit board contacts and the respective pluggable power input contact is inversely related to a quantity of the plurality of pluggable power input contacts.

17. The power connector of claim 14, being packaged together with a ground connector that includes a plurality of pluggable ground contacts to removably plug into the power distribution system and a plurality of ground circuit board contacts to affix to the circuit board;

electrical insulation between the conductive body and the ground connector; and separate housings to enclose each respective pair of pluggable power input contact and pluggable ground contact.

18. The power connector of claim 17, wherein the housings include mating features to blind-mate to the power distribution system.

19. A system comprising:

a circuit board; and a power connector installed on the circuit board, the power connector including:

a pluggable power input contact to removably plug into a power distribution system external to the circuit board, a circuit board contact to affix to a power trace of the circuit board, and a conductive body with an integral fusible region connecting the pluggable power input contact and the circuit board contact, wherein the integral fusible region has an interrupting rating greater than an interrupting rating of a primary fuse of the circuit board.

20. The system of claim 19, wherein the circuit board and the power connector are enclosed in a computing system, and the power distribution system is in an enclosure to which the computing system is removably installable.

* * * * *